US011410843B1

(12) United States Patent
Jiang

(10) Patent No.: US 11,410,843 B1
(45) Date of Patent: Aug. 9, 2022

(54) MASS SPECTROMETRY SYSTEM AND MEASURING METHOD THEREOF

(71) Applicant: Qixianhe (Beijing) Technology Co., Ltd., Beijing (CN)

(72) Inventor: Shan Jiang, Beijing (CN)

( * ) Notice: Subject to any disclaimer, the term of this patent is extended or adjusted under 35 U.S.C. 154(b) by 0 days.

(21) Appl. No.: 17/581,952

(22) Filed: Jan. 23, 2022

(30) Foreign Application Priority Data

Nov. 15, 2021 (CN) ..... 202111345454.9

(51) Int. Cl.
*H01J 49/26* (2006.01)
*H01J 49/10* (2006.01)
*H01J 49/00* (2006.01)

(52) U.S. Cl.
CPC ..... *H01J 49/26* (2013.01); *H01J 49/0031* (2013.01); *H01J 49/10* (2013.01)

(58) Field of Classification Search
CPC ..... H01J 49/26; H01J 49/0031; H01J 49/10
USPC ..... 250/281, 282, 288
See application file for complete search history.

(56) References Cited

U.S. PATENT DOCUMENTS 6,710,334 B1 * 3/2004 Twerenbold ..... H01J 49/025 250/288
2021/0313158 A1 10/2021 Zhou et al.
2021/0313161 A1 10/2021 Sun et al.

FOREIGN PATENT DOCUMENTS

CN 107887251 A 4/2018
CN 109346396 A 2/2019

* cited by examiner

*Primary Examiner* — Michael Maskell

(57) ABSTRACT

Provided are a mass spectrometry system and a measuring method thereof. The mass spectrometry system comprises an ion source subsystem, an ion accelerator subsystem, a high-energy analyzer subsystem and a particle identification and detector subsystem which are sequentially connected. The ion source subsystem comprises a sampler component and a super-strong ionization ion source component connected with the sampler component; the high-energy analyzer subsystem comprises an analyzer component connected with the ion accelerator subsystem and a beam measuring component connected with the analyzer component; and the detector subsystem comprises a film connected with the beam measuring component and a detector connected with the film. A super-strong ionization technology is employed to eliminate interference of molecular ions; and an atomic number Z can be detected by using a particle identification technology, so as to obtain isobaric ions and information of ions with different mass numbers but the same M/q.

10 Claims, 2 Drawing Sheets

MASS SPECTROMETRY SYSTEM AND MEASURING METHOD THEREOF

CROSS-REFERENCE TO RELATED APPLICATIONS

The present application claims foreign priority of Chinese Patent Application No. 202111345454.9, filed on Nov. 15, 2021 in the China National Intellectual Property Administration, the disclosures of all of which are hereby incorporated by reference.

TECHNICAL FIELD

The present invention relates to the technical field of mass spectrograph, and, more particularly, to a mass spectrometry system and a measuring method thereof.

BACKGROUND

Since the advent of mass spectrograph (MS) in 1910, all MS (comprising magnetic mass spectrum, quadrupole and flight time) measuring results are obtained mass-to-charge ratio (M/q) spectra, rather than real mass spectrum.

In the same M/q spectrum, there are mainly four different ions, wherein the first ion is an ion of a nuclide to be measured; the second ion is an isobaric ion of the nuclide to be measured; the third ion is a molecular ion with the same mass number as the nuclide to be measured; and the fourth ion is an ion with different mass numbers but the same M/q as the nuclide to be measured (the mass number and the charge state are both integer multiples of the nuclide to be measured).

For example, for the measurement of K isotopes in a geological sample, it is necessary to measure abundances of 39K, 40K and 41K isotopes. M/q is equal to 40 at the location of 40K, and there are mainly four ions, wherein the first ion is a nuclide $40K^+$ to be measured; the second ion is isobaric ions $40Ar^+$ and $40Ca^{2+}$ of 40K; the third ion is a molecular ion (which is also called polyatomic particle) with the same mass number as 40K, such as $39KH^+$ and $28SiC^+$; and the fourth iron is an ion with different mass numbers but the same M/q, such as $80Se^{2+}$ and $120Sn^{3+}$. All the ions fall on the location where M/q is equal to 40.

At present, none MS can measure the mass spectrum of the above four ions simultaneously. A real mass spectrum should be that: the above four ions can be distinguished at a location of the same M/q, and the nuclides to be measured are recorded. Meanwhile, interfering ions therein, such as molecular ions can be excluded.

To enable the MS to distinguish various different ions on the same M/q to obtain the real mass spectrum, two problems have to be solved. Firstly, the isobaric ions can be distinguished from the ions with different mass numbers but the same M/q; and secondly, all molecular ions with the same mass number (the molecular ion is one of the most important interferences and backgrounds) can be excluded.

Therefore, it is necessary to design a new mass spectrometry system and a measuring method thereof.

SUMMARY

The object of the present invention is to provide a mass spectrometry system and a measuring method thereof, which can realize measurement of real mass spectrum and greatly improve the measuring sensitivity and measuring accuracy.

The present invention provides a mass spectrometry system, which comprises an ion source subsystem, an ion accelerator subsystem, a high-energy analyzer subsystem and a particle identification and detector subsystem which are sequentially connected; wherein the ion source subsystem comprises a sampler component and a super-strong ionization ion source component connected with the sampler component; the high-energy analyzer subsystem comprises an analyzer component connected with the ion accelerator subsystem and a beam measuring component connected with the analyzer component; and the detector subsystem comprises a film connected with the beam measuring component and a detector connected with the film.

Further, the film has one way or two ways, and a number of the detector is equal to that of the film.

Further, the detector comprises a first anode and a second anode arranged at intervals, a cathode and a grid which are both opposite to the first anode and the second anode, and an entrance window located between the grid and the cathode; wherein the grid is located between the cathode and both the first anode and the second anode, and incident particles enter between the grid and the cathode through the entrance window.

Further, the ion accelerator subsystem comprises a pre-accelerator component connected with the super-strong ionization ion source component, an electrostatic analyzer component connected with the pre-accelerator component, and an accelerator component connected with the electrostatic analyzer component; and the analyzer component passes through the accelerator component and then is connected with the electrostatic analyzer component.

Further, the ion source subsystem further comprises a high-voltage stage, wherein the sampler component, the super-strong ionization ion source component, the pre-accelerator component and the electrostatic analyzer component are located in the high-voltage stage Further, the analyzer component comprises a magnetic analyzer passing through the accelerator component and then connected with the electrostatic analyzer component, a quadrupole analyzer connected with the magnetic analyzer and a time-of-flight analyzer.

The present invention further provides a measuring method of a mass spectrometry system, comprising the following steps of:

S1: transforming, by a sampler component, a sample into a gas state or a fog state;

S2: performing, by a super-strong ionization ion source component, a super-strong ionization technology on the gas state or fog state formed in step S1 and generating ion beam currents of multiple charge states;

S3: performing, by an ion accelerator subsystem, energy filtering on the ion beam currents of multiple charge states and accelerating the ion beam currents of multiple charge states to higher energy;

S4: analyzing or separating, by a high-energy analyzer subsystem, the accelerated ion beam currents according to magnitudes of M/q, and measuring a magnitude of an ion beam current of each M/q; and S5: identifying, by a detector subsystem, a variety of isobaric ions with different masses but the same M/q, and simultaneously recording an ion beam current or single ion count of each nuclide to be measured.

Further, step S3 particularly comprises: performing, by a pre-accelerator component, preliminary acceleration on the ion beam currents of multiple charge states; performing, by an electrostatic analyzer component, energy focusing on the accelerated ion beams; and further accelerating, by an accelerator component, the ion beams to higher energy.

Further, step S4 particularly comprises: distinguishing, by an analyzer component, ions with different mass-to-charge ratios according to magnitudes of the mass-to-charge ratios; and measuring, by a beam measuring component, a beam current of an isotope or nuclide separated by the analyzer component.

Further, step S5 particularly comprises: distinguishing, by a film, isobaric ions from ions with different mass numbers but the same M/q.

According to the present invention, a super-strong ionization technology is employed to eliminate interference of molecular ions; and an atomic number Z can be detected by using a particle identification technology, so as to obtain isobaric ions and information of ions with different mass numbers but the same M/q, which is ZM/q information, and finally realize measurement of real mass spectrum. The present invention has the advantages being capable of greatly improving the measuring sensitivity, improving the measuring accuracy, reducing the detection line, reducing measuring error, reducing the measurement time, and the like.

BRIEF DESCRIPTION OF THE DRAWINGS

FIG. 3(*b*) is a comparison of real mass spectrum of the present invention.

DETAILED DESCRIPTION

To make the objects, technical solutions, and advantages of the present invention clearer, the present invention will be further described in details hereinafter with reference to the accompanying drawings and embodiments. It should be understood that the specific embodiments described herein are only used to explain the present invention, but are not intended to limit the present invention.

The present invention discloses a mass spectrometry system, which realizes measurement of real mass spectrum, and has the advantages being capable of greatly improving the measuring sensitivity, improving the measuring accuracy, reducing the detection line, reducing measuring error, reducing the measurement time, and the like.

Figure 1:
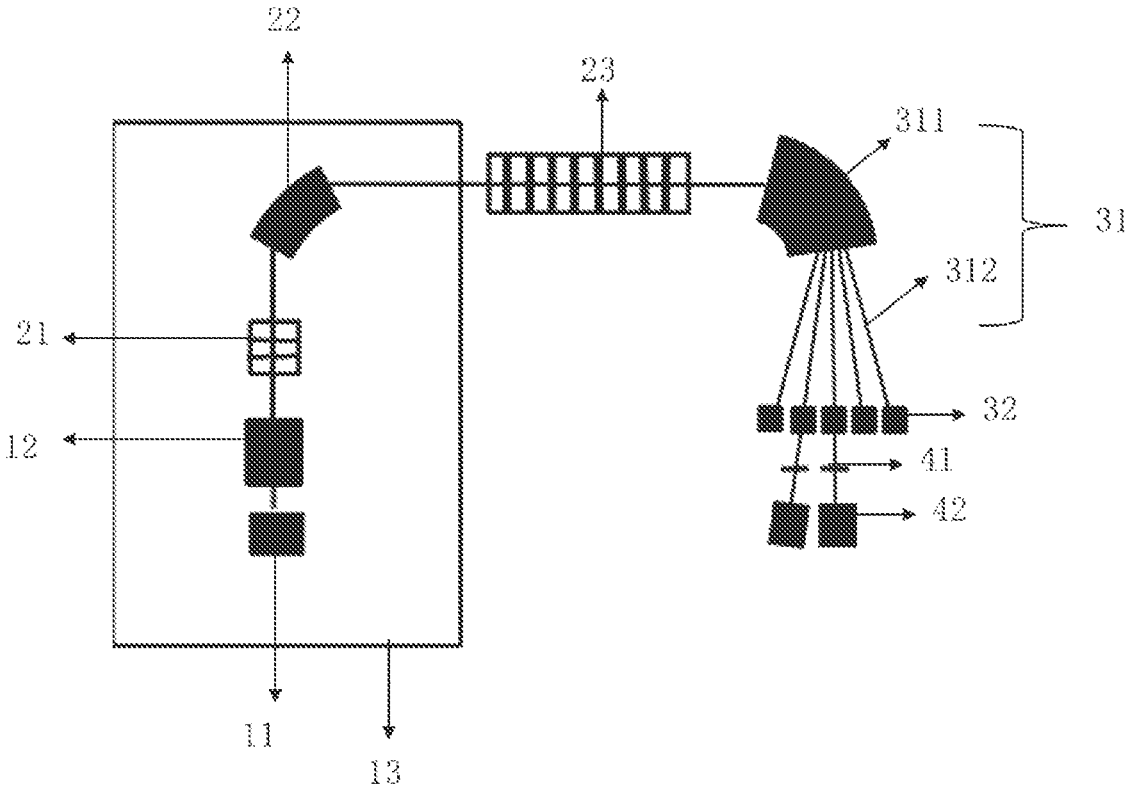
FIG. 1 is a simplified structural diagram of a mass spectrometry system of the present invention.

As shown in FIG. 1, the mass spectrometry system comprises four subsystems, which are specifically an ion source subsystem, an ion accelerator subsystem, a high-energy analyzer subsystem and a particle identification and detector subsystem. The ion source subsystem, the ion accelerator subsystem, the high-energy analyzer subsystem and the particle identification and detector subsystem are sequentially connected.

The ion source subsystem is used to uniformly vaporize samples and extract ion beam currents with multiple charge states, and comprises: a sampler component 11, a super-strong ionization ion source component 12 connected with the sampler component 11 and a high-voltage stage 13, wherein the sampler component 11 and the super-strong ionization ion source component 12 are located in the high-voltage stage 13.

The sampler component 11 is a component that applies high-temperature heating, laser beam ablation, laser micro and ion beam to a solid or liquid sample, so that the sample can be transformed into a gas state or fog state.

Multiple charge states refer to an ion source stripping off more than two electrons, that is, 2+, 3+, 4+, . . . , and even fully stripped charge state. The super-strong ionization ion source component 12 is proposed for two types of ion sources comprising strong ionization and soft ionization, and an extracted beam current may be in the range of 1 nA to 1 mA (particle beam current) and is continuously adjusted.

The ions of multiple charge states are extracted from the ion source on the basis of the function of the super-strong ionization ion source component 12, thus excluding all molecular ions. Because all the molecular ions can be disintegrated simultaneously while stripping off multiple electrons, for example, ions of $40K^{3+}$ or higher charge states are generated when measuring 40K, and $39KH^{3+}$ and $28SiC^{3+}$ are disintegrated, so the interference of the molecular ions disappears.

The super-strong ionization technology means that the ion source has a strong ionization effect, the ionization energy is generally in a range of $10^3$ eV to $10^6$ eV, which can strip off multiple extra-nuclear electrons, such as 2+, 3+, 4+, . . . , and even strip off all the electrons. For example, for a C atom, $C^{2+}$, $C^{3+}$, $C^{4+}$, $C^{5+}$ and $C^{6+}$ can be stripped off. In this way, one of the main backgrounds affecting mass spectrograph measurement, namely molecular ions, disappears. Therefore, the molecular background problem that has puzzled mass spectra for decades is solved.

There are many ion sources having super-strong ionization functions, comprising: Electron Beam Ion Trap ion source (EBIT), Panning ion source (Panning), Electron Cyclotron Resonance ion source (ECR), and the like.

The super-strong ionization ion source component 12 of the present invention adopts an Electron Cyclotron Resonance (ECR) ion source with multiple charge states, and a microwave frequency of the ECR ion source is in a range of 5 GHz to 50 GHz.

The high-voltage stage 13 is used to support and insulate a pre-accelerator.

The ECR ion source belongs to the super-strong ionization technology, which can generate ion beam currents with multiple charge states. Generating ions with multiple charge states for MS analysis has two functions. One function is that when multiple charge states are extracted from the ion source, the molecular ions are effectively disintegrated. When the charge state is greater than or equal to 3+, all the molecular ions are disintegrated. The second function is that the ion energy is improved, and a magnitude of the ion energy is directly proportional to the number of charge states. The higher the charge state is, the higher the ion energy is, so that it is more conducive to identify and distinguish the isobaric ions.

On one hand, the ion accelerator subsystem performs energy filtering on the ions and on the other hand, accelerates the ions to higher energy.

The ion accelerator subsystem comprises a pre-accelerator component 21 connected with the super-strong ionization ion source component 12, an electrostatic analyzer component 22 connected with the pre-accelerator component 21, and an accelerator component 23 connected with the electrostatic analyzer component 22. The pre-accelerator component 21 and the electrostatic analyzer component 22 are also located in the high-voltage stage 13, while the accelerator component 23 is located outside the high-voltage stage 13.

The pre-accelerator component 21 performs preliminary acceleration on the ion beam currents extracted from the ion source in order to perform better double focusing on the ion beam currents. An acceleration voltage of the pre-accelerator component 21 is generally adjustable in a range of 20 kV to 200 kV.

The electrostatic analyzer component 22 is used for energy focusing, and is intended to eliminate the interferences of high-energy and low-energy tails of a main isotope to other isotopes and impurity nuclides.

The accelerator component 23 is used to further accelerate the ions to higher energy, for the purpose of distinguishing multiple isobaric ions, such as 40K, 40Ca and 40Ar ions.

On one hand, the level of the ion energy depends on the mass number of two heterotopic ions that are distinguished. The larger the mass number is, the higher the ion acceleration energy is. On the other hand, the level of the ion energy also depends on the level of the charge state selected. The higher the charge state is, the higher the energy is. One of 11+, 12+ and 13+ charge states may be selected for isobaric ions such as 40K. An acceleration voltage of accelerator component 23 is generally adjustable in an acceleration voltage range of 10 kV to 800 kV.

The high-energy analyzer subsystem is used to analyze (or separate) the accelerated ions according to magnitudes of M/q, and measure a magnitude of an ion beam current of each M/q.

The high-energy analyzer subsystem comprises an analyzer component passing through the accelerator component 23 and then connected with the electrostatic analyzer component 22 and a beam measuring component 32 connected with the analyzer component 31.

The analyzer component 31 comprises a magnetic analyzer 311 passing through the accelerator component 23 and then connected with the electrostatic analyzer component 22, a quadrupole analyzer 312 connected with the magnetic analyzer 311 and a time-of-flight analyzer (not shown in the drawings). The analyzer component 31 is used for momentum analysis to distinguish ions with different mass-to-charge ratios according to magnitudes of the mass-to-charge ratios.

The beam measuring component 32 is a Faraday cup for measuring the beam currents of isotopes or nuclides separated by the magnetic analyzer 311. A number of the Faraday cups depends on a number of isotopes to be measured and a sum of different impurity types. For example, for K—Ar dating, in addition to 40K and 40Ar, it is necessary to measure the isotope beam currents of 39K, 41K, 36Ar, 38Ar, 42Ca, 44Ca and other nuclide beam currents of 24Mg, 31P, 27Al and 28Si with Faraday cups. A number of the Faraday cups used is generally set in a range of 5 to 50 or even a larger range.

The detector subsystem identifies a variety of isobaric ions with different masses but the same M/q, and simultaneously recording an ion beam current or single ion count of each nuclide to be measured.

The detector subsystem comprises a film 41 having one or two ways, and a detector 42 with the same number as the film 42. The film 41 is connected with the beam measuring component 32, and the detector 42 is connected with the film 41.

The film 41, also called an energy absorbing film, is used to distinguish isobaric ions from ions with different mass numbers but the same M/q.

Because of the different atomic numbers, when two isobars with the same energy and the same charge state, such as $40C^{11+}$ and $40K^{11+}$, pass through the film, the energy losses in the film are different. After passing through the film 41, the own residual energy of the two isobars is also different. The two isobars and a ratio thereof can be identified by measuring the energy and count of the two isobars with the detector 42. A solid with uniform thickness is usually adopted as the film; for example, silicon nitride ($Si_3N_4$) is used as the energy absorbing film, and a thickness thereof is in a range of 30 nm to 3,000 nm.

A number of the single particle energy detector 42 is the same as that of the energy absorbing film 41, and a semiconductor detector or gas detector is usually selected as the detector 42. The semiconductor detector is adopted for light ions such as H, He, Li and Be, and a gas ionization chamber detector is generally used for ions of C, N, O and heavier elements.

Figure 2:
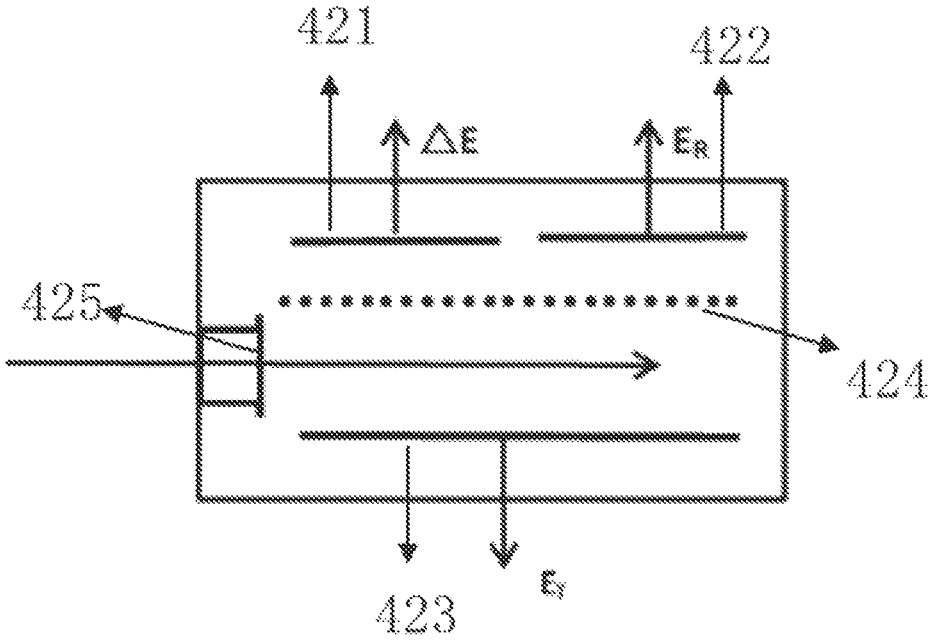
FIG. 2 is a schematic structural diagram of a detector of the present invention.

As shown in FIG. 2, the detector 42 comprises a first anode 421 and a second anode 422 arranged at intervals, a cathode 423 and a grid 424 which are both opposite to the first anode 421 and the second anode 422, and an entrance window 425 located between the grid 424 and the cathode 423. The grid 424 is located between the cathode and both the first anode 421 and the second anode 422.

Incident particle enter between the grid 424 and the cathode 423 through the entrance window 425.

The detector subsystem can identify particles and accurately determine an atomic number Z of each component in the same M/q, so as to distinguish the isobaric ions from ions with different mass numbers but the same M/q. For example, when measuring $40K^+$, the isobars $40Ar^+$ and $40Ca^+$ can be distinguished by the particle identification technology, and nuclides with different mass numbers but the same M/q such as $80Se^{2+}$ and $120Sn^{3+}$ can be distinguished. Finally, a M/q spectrum related to the atomic number Z, i.e., ZM/q spectrum, is obtained, and thus, the real mass spectrum is obtained.

Particle identification is a detector technology aiming at multiple isobars with the same energy in nuclear physics experiments, which has the ability to identify and record multiple isobars with the same energy (such as 40K, 40Ar and 40Ca).

The principle of the particle identification is that an energy loss rate (dE/dx) of a charged ion with certain kinetic energy in a gas or solid detector is positively correlated with a nuclear charge number (Z) of the ion, that is, $DE/DX \propto MZ^2/E$.

In the detector, multiple dE/dx units are stacked together, so that the energy loss ($\Delta E$) is obtained by accumulating dE. Then: $dE/dxa \propto MZ^2/E$ is transformed into $E\Delta E \propto MZ^2$. The information of the atomic number Z can be obtained by measuring the total energy (E) and $\Delta E$ of the ion.

Figure 3A:
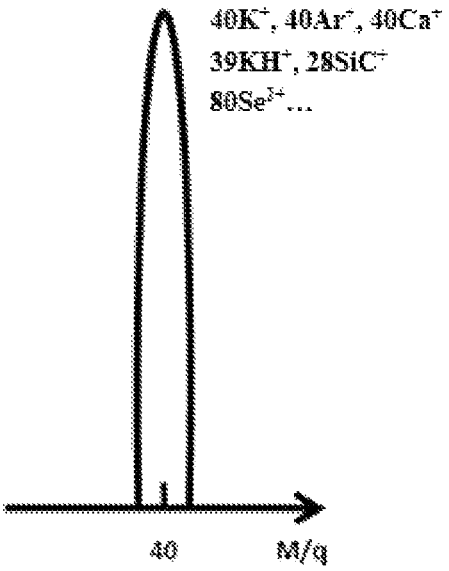
FIG. 3(*a*) is a M/q spectrum measured by the existing MS.
Figure 3B:
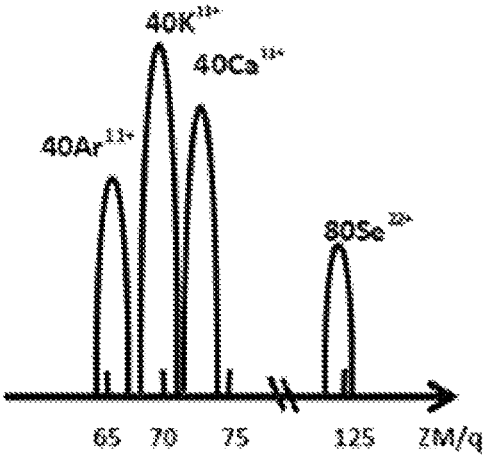

FIG. 3(*a*) is a M/q spectrum measured by the existing MS; and FIG. 3(*b*) is a comparison of real mass spectrum of the present invention. FIG. 3 (*a*) is a spectrum with a M/q of 40 measured by the existing MS, which contains four ions with different compositions. FIG. 3(*b*) is direct to M/q being 40, and shows the real mass spectrum of the present invention, i.e., ZM/q spectrum, which has no molecular ions at all, and ZM/q values of $40K^{11+}$, $40A^{11+}$ and $40A^{11+}$ are 65.45, 69.09 and 72.73 respectively, while the difference ZM/q 123.64 of $80Se^{22+}$ is even greater.

The present invention further discloses a measuring method of a mass spectrometry system, comprising the following steps of:

S1: transforming, by a sampler component 11, a sample into a gas state or a fog state;

S2: performing, by a super-strong ionization ion source component 12, a super-strong ionization technology on the gas state or fog state formed in step S1 and generating ion beam currents of multiple charge states;

S3: performing, by an ion accelerator subsystem, energy filtering on the ion beam currents of multiple charge states and accelerating the ion beam currents of multiple charge states to higher energy, which particularly comprises: performing, by a pre-accelerator component 21, preliminary acceleration on the ion beam currents of multiple charge states; performing, by an electrostatic analyzer component 22, energy focusing on the accelerated ion beams; and further accelerating, by an accelerator component 23, the ion beams to higher energy.

S4: analyzing or separating, by a high-energy analyzer subsystem, the accelerated ion beam currents according to magnitudes of M/q, and measuring a magnitude of an ion beam current of each M/q, which particularly comprises: distinguishing, by an analyzer component 31, ions with different mass-to-charge ratios according to magnitudes of the mass-to-charge ratios; and measuring, by a beam measuring component 32, a beam current of an isotope or nuclide separated by the analyzer component 31; and S5: identifying, by a detector subsystem, a variety of isobaric ions with different masses but the same M/q, and simultaneously recording an ion beam current or single ion count of each nuclide to be measured, which particularly comprises: distinguishing, by a film 41, isobaric ions from ions with different mass numbers but the same M/q.

The present invention has the advantages as follows.

Firstly, measure of real mass spectrum is realized.

M/q spectra, rather than real mass spectra are obtained through all the existing MS measurements. The mass spectrometry system of the present invention can realize the measurement of real mass spectrum, and one real mass spectrum can measure all four components in the same M/q.

Secondly, super-strong ionization, without the interference of molecular ions and molecular fragment ion background, significantly improves the measuring sensitivity:

Due to the use of the super-strong ionization ion source component, the molecules and the ion backgrounds of ions will be disintegrated and eliminated, and the ion backgrounds of molecular fragments will also be eliminated. Therefore, the measuring sensitivity of all the MS will be greatly improved by $10^2$ times to $10^6$ times.

Thirdly, super-strong ionization increases the ionization efficiency and transmission efficiency, and greatly improves the measuring accuracy:

The beam current intensity can be increased by 10 times to 100 times, the transmission line rate can be increased by 2 times to 10 times, and the total efficiency can be increased by 20 times to 2,000 times. Therefore, the measuring accuracy can be improved by 4 times to 40 times. For the measurement of isotopes or impurities with low content (less than 100 ppm), the measuring accuracy can be improved by more than 100 times.

Fourthly, using the particle identification technology can simultaneously measure multiple isobars, thus opening up multiple new application fields:

For example, 48Ca and 48Ti can be measured simultaneously, so as to realize the measurement of human isotope fingerprints of Ca and Ti and realize the early diagnosis of some diseases. Simultaneous measurement of geological beta decay series with the isobaric nuclides, such as 40k, 40Ar and 40Ca, is realized, which provides a reliable analysis method for the quasi-dating of K—Ar and K—Ca. Accurate measurement for 87Ru-87Sr, 176Lu-176Hf, 187Re-187Os and other decay series can also be realized. The application of micro-section measurement and related disciplines which react with (n,p) and (p,n) can also be expanded.

According to the present invention, a super-strong ionization technology is employed to eliminate interference of molecular ions; and an atomic number Z can be detected by using a particle identification technology, so as to obtain isobaric ions and information of ions with different mass numbers but the same M/q, which is ZM/q information, and finally realize measurement of real mass spectrum. The present invention has the advantages being capable of greatly improving the measuring sensitivity, improving the measuring accuracy, reducing the detection line, reducing measuring error, reducing the measurement time, and the like.

The above description is merely preferred embodiments of the present invention, but is not intended to limit the present invention in any form. Although the present invention has been disclosed by the preferred embodiments above, the preferred embodiments are not intended to limit the present invention. Anyone who is familiar with this art can make some changes or modifications to equivalent embodiments of equivalent changes by using the technical contents disclosed above without departing from the scope of the technical solutions of the present invention. Any simple amendments, equivalent changes and modifications made to the above embodiments according to the technical essences of the present invention without departing from the contents of the technical solutions of the present invention, are still within the scope of the technical solutions of the present invention.

The invention claimed is:

1. A mass spectrometry system, comprising an ion source subsystem, an ion accelerator subsystem, a high-energy analyzer subsystem and a particle identification and detector subsystem which are sequentially connected; wherein the ion source subsystem comprises a sampler component (11) and a super-strong ionization ion source component (12) connected with the sampler component (11); the high-energy analyzer subsystem comprises an analyzer component (31) connected with the ion accelerator subsystem and a beam measuring component (32) connected with the analyzer component (31); and the detector subsystem comprises a film (41) connected with the beam measuring component (32) and a detector (42) connected with the film (41).

2. The mass spectrometry system according to claim 1, wherein the film (41) has one way or two ways, and a number of the detector (42) is equal to that of the film.

3. The mass spectrometry system according to claim 1, wherein the detector (42) comprises a first anode (421) and a second anode (422) arranged at intervals, a cathode (423) and a grid (424) which are both opposite to the first anode (421) and the second anode (422), and an entrance window (425) located between the grid (424) and the cathode (423); wherein the grid (424) is located between the cathode (423) and both the first anode (421) and the second anode (422), and incident particles enter between the grid (424) and the cathode (423) through the entrance window (425).

4. The mass spectrometry system according to claim 1, wherein the ion accelerator subsystem comprises a pre-accelerator component (12) connected with the super-strong ionization ion source component (12), an electrostatic analyzer component (22) connected with the pre-accelerator component (21), and an accelerator component (23) connected with the electrostatic analyzer component (22); and the analyzer component (31) passes through the accelerator component (23) and then is connected with the electrostatic analyzer component (22).

5. The mass spectrometry system according to claim 4, wherein the ion source subsystem further comprises a high-voltage stage (13), the sampler component (11), the super-strong ionization ion source component (12), the pre-accelerator component (21) and the electrostatic analyzer component (22) are located in the high-voltage stage (13).

6. The mass spectrometry system according to claim 4, wherein the analyzer component (31) comprises a magnetic analyzer (311) passing through the accelerator component (23) and then connected with the electrostatic analyzer component (22), a quadrupole analyzer (312) connected with the magnetic analyzer (311) and a time-of-flight analyzer.

7. A measuring method of a mass spectrometry system, comprising the following steps of:

S1: transforming, by a sampler component, a sample into a gas state or a fog state;

S2: performing, by a super-strong ionization ion source component, a super-strong ionization technology on the gas state or fog state formed in step S1 and generating ion beam currents of multiple charge states;

S3: performing, by an ion accelerator subsystem, energy filtering on the ion beam currents of multiple charge states and accelerating the ion beam currents of multiple charge states to higher energy;

S4: analyzing or separating, by a high-energy analyzer subsystem, the accelerated ion beam currents according to magnitudes of M/q, and measuring a magnitude of an ion beam current of each M/q; and S5: identifying, by a detector subsystem, a variety of isobaric ions with different masses but the same M/q, and simultaneously recording an ion beam current or single ion count of each nuclide to be measured.

8. The measuring method of the mass spectrometry system according to claim 7, wherein step S3 particularly comprises: performing, by a pre-accelerator component, preliminary acceleration on the ion beam currents of multiple charge states; performing, by an electrostatic analyzer component, energy focusing on the accelerated ion beams; and further accelerating, by an accelerator component, the ion beams to higher energy.

9. The measuring method of the mass spectrometry system according to claim 7, wherein step S4 particularly comprises: distinguishing, by an analyzer component, ions with different mass-to-charge ratios according to magnitudes of the mass-to-charge ratios; and measuring, by a beam measuring component, a beam current of an isotope or nuclide separated by the analyzer component.

10. The measuring method of the mass spectrometry system according to claim 7, wherein step S5 particularly comprises: distinguishing, by a film, isobaric ions from ions with different mass numbers but the same M/q.

* * * * *